United States Patent [19]

Gerver et al.

[11] Patent Number: 4,832,191

[45] Date of Patent: May 23, 1989

[54] CALCULATOR HOLDER

[75] Inventors: Robert Gerver, Glen Oakes; Richard J. Sgroi, Rhinebeck, both of N.Y.

[73] Assignee: South-Western Publishing Co., Cincinnati, Ohio

[21] Appl. No.: 154,864

[22] Filed: Feb. 10, 1988

[51] Int. Cl.[4] ..... B65D 69/00

[52] U.S. Cl. ..... 206/232; 206/328; 206/305

[58] Field of Search ..... 206/232, 328, 334, 37, 206/305

[56] References Cited

U.S. PATENT DOCUMENTS 3,146,004 8/1964 Kidd .

4,075,702 2/1978 Davies .

4,096,577 6/1978 Ferber et al. .

*Primary Examiner*—Joseph Man-Fu Moy

*Attorney, Agent, or Firm*—Wood, Herron & Evans

[57] ABSTRACT

A calculator holder for attaching a calculator to the cover of a book has a cardboard sleeve adapted to fit over either the front or back cover of a book. A flap is hingably connected to the bottom edge of the sleeve and has a thin calculator supported therein. The flap may be folded about the bottom edge of the book to reside between the book cover and the book pages when the book is closed during non-use, or unfolded to an open position to expose the calculator for use in conjunction with the book. Use of the calculator does not interfere with the turning of pages required during normal use of the book.

1 Claim, 1 Drawing Sheet

CALCULATOR HOLDER

FIELD OF THE INVENTION

This invention relates to a calculator holder and more particularly to a calculator holder for attaching a calculator to a book. The holder provides for both the use of a calculator in conjunction with the book during periods of instruction and convenient storage of the calculator with the book during periods of non-use.

BACKGROUND OF THE INVENTION

Calculators have enjoyed tremendous popularity in recent years. To some extent, this popularity has resulted from increased convenience associated with reductions in the overall size of calculators. In addition to increased portability due to size reduction, calculators which take up less space have proved advantageous in numerous applications where prior, larger calculators were impractical.

For example, U.S. Pat. No. 4,075,702, issued to Davies on Feb. 22, 1978, discloses a wallet enclosure for holding an electronic calculator. According to this disclosure, a thin calculator may be placed within the wallet enclosure which also serves as a checkbook, thereby providing easy access to electronic calculation when writing checks. The wallet enclosure may be folded with the calculator therein and easily placed within a pocket.

U.S. Pat. No. 4,096,577, issued to Ferber et al. on June 20, 1978 also discloses a thin electronic calculator housed between two layers of thin flexible vinyl to form one side of a thin, flexible folder, the other side of which carries a pad or business form such as a checkbook.

Calculators also play an increasingly important role in the education process. As part of the curriculum, many school systems now require that students be taught how to use a calculator. In meeting this requirement, it has proved advantageous to instruct students in the use of a calculator by also providing accompanying material, such as a textbook. Instructions as to the use of the calculator can be provided in the textbook. Alternatively, a math book or an accounting book has proven particularly appropriate for instructing in the use of a calculator.

When a calculator is used with an accompanying textbook in the learning process, the two articles actually serve as one learning tool. It is thus advantageous to have the calculator physically attached to the textbook in a manner that does not interfere with normal use of the textbook. At the same time, it would also be convenient if the manner of attaching a calculator to a textbook would provide a non-use position for the attacted calculator and holder, so that the textbook, the calculator and the calculator holder could be stored together during periods of non-use. This would save storage space and/or time in distributing otherwise separate teaching material to students prior to instruction.

Prior inventions have provided means for attaching articles to textbooks. For example, U.S. Pat. No. 3,146,004, issued to Kidd on Aug. 25, 1964 discloses a sleeve for attachment to the cover of a book which is adapted to hold a pad of paper and pencil. After a period of use, the holder is detached from the book and carried in a pocket or handbag. Thus, although Kidd provides an attachment for using a conventional note pad in conjunction with a textbook, the user is still required to carry the holding attachment separately.

The convenience provided by having access to a conventional note pad while using a textbook is lost by the fact that the holder, the book and the note pad must be carried separately.

It is therefore desirable to provide a calculator holder for attaching a calculator to a textbook in a manner that does not interfere with the normal use of the textbook for advantageous use in teachning how to use a calculator.

it is also desirable to provide such a calculator holder which remains attached to the book during periods on non-use, so that the textbook, the calculator, and the calculator holder may be conveniently stored together in one place.

SUMMARY OF THE INVENTION

To achieve these ends, the invention provides a calculator holder that has a sleeve adapted to fit over the cover of a textbook, a flap hinged to the sleeve at a bottom edge thereof, and a calculator held within the flap. The flap is hinged with respect to the sleeve to provide both a closed position during non-use of the calculator and an open position during use of the calculator. In the closed position, the flap is pivoted about the bottom edge of the sleeve to lie on the top surface of the sleeve. The book may be closed and stored in this manner with the flap residing between the cover of the book and the pages of the book. When the book is opened for use, the flap holding the calculator can be folded downwardly to extend outwardly from the bottom edge of the book. In this open position, the calculator is exposed for use. Preferably, the flap has separate top and bottom panels with the calculator residing therebetween. The top panel of the flap has windows formed therein which enable a user to operate and view the calculator. Because the flap extends downwardly from the bottom edge of the book, use of the calculator does not interfere with use of the book.

The sleeve may be placed over either the front or back cover of the book, thus facilitating use be either left-handed or right-handed individuals. The sleeve and flap are preferably cardboard, with the flap at a bottom edge of the sleeve hingable by folding along fold lines. Thus, a calculator may be conveniently attached to and stored with a book during periods of use or non-use.

If desired, reduce stress on the binding of the book, the book may be physically altered to provide space for the calculator.

DETAILED DESCRIPTION OF THE DRAWINGS

Figure 1:
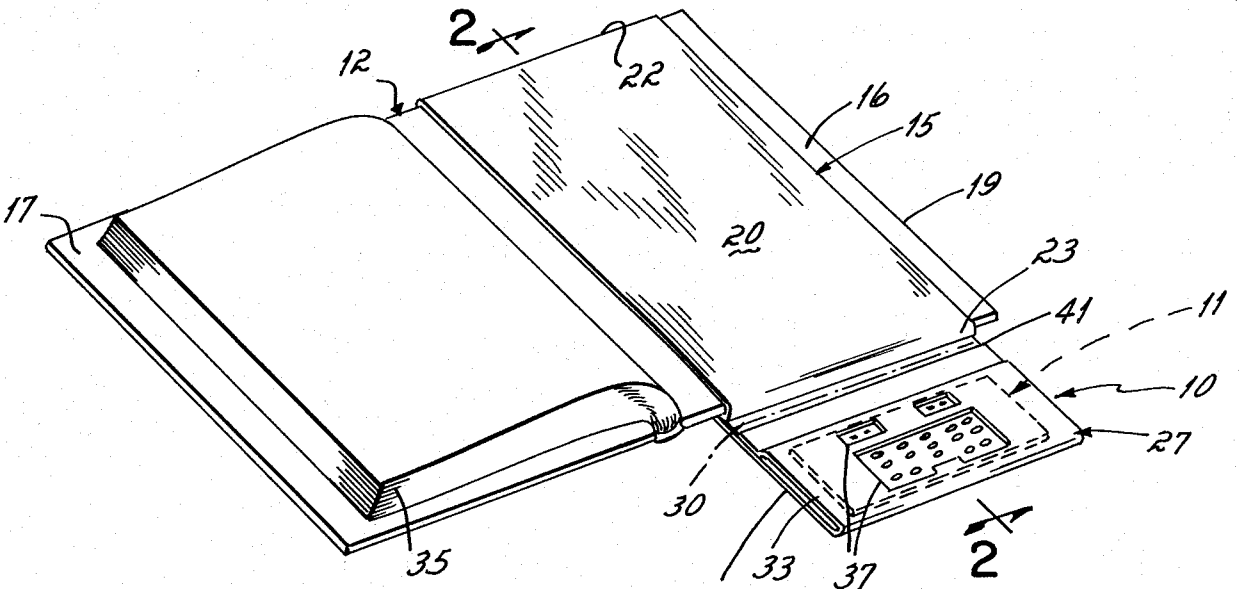
FIG. 1 is an isometric view of the calculator holder of this invention in place upon the back cover of a textbook with the calculator in an exposed position.

Referring to FIG. 1, a calculator holder 10 may be used for attaching a calculator 11 to a book 12 for advantageous use in instructing how to use the calculator 11. The calculator holder of this invention may be used advantageously with almost any size book, although a standard hard cover textbook is preferred. The calculator 11 itself may be any relatively thin calculator.

The calculator holder 10 has a sleeve 15 which is adapted to fit over either the back cover 16 or the front cover 17 of book 12. It appears that right-handers prefer placement of sleeve 15 over the back cover 16 of the book 12 as shown in FIG. 1 while left-handers may prefer placement of sleeve 15 over front cover 17. Placement of sleeve 15 over either cover is accomplished by simply sliding the sleeve 15 over a side edge 19 of the book cover so that the book cover snuggly resides between a front surface 10 and a back surface 21 of sleeve 15. Sleeve 15 also has first and second edges 22 and 23, respectively, corresponding to the top and bottom edges of book 12.

Extending from first, or bottom, edge 23 of sleeve 15 is a flap 27. Flap 27 is hinged to bottom edge 23 of sleeve 15 and is pivotable with respect to sleeve 15 to provide both a closed position and an open position. In the closed position, flap 27 rests upon front surface 10 of sleeve 15 so that the book may be closed. In the open position, flap 27 extends outwardly from bottom edge 23. Preferably, both sleeve 15 and flap 27 are cardboard, and flap 27 is hinged with respect to sleeve 15 along a fold line 30.

Flap 27 has a top panel 33 and a bottom panel 34 to form a partially enclosed pocket with calculator 11 residing therebetween. In the closed position, top panel 33 of flap 27 rests on front surface 20 of sleeve 15.

Top panel 33 includes or defines windows or apertures 37 formed therein to expose the face of calculator 11 for use by the operator. The type of apertures 37 and their shape will be dictated by the particular calculator 11 used.

With the book 12 open and flap 27 in an open position as shown in FIG. 1, the calculator 11 is exposed for operation by the user in conjunction with the book 12. Because flap 27 extends outwardly from the bottom edge of the book 12, operation of the calculator 11 does not interfere with turning of the pages 35 of the book. After use, flap 27 may be pivoted to the closed position. To achieve the closed position 35, the book is opened as shown in FIG. 1 and flap 27 is then pivoted about bottom edge 23 by folding along fold line 30 as shown by arrow 45. This places front panel 33 of flap 27 upon front surface 20 of sleeve 15. With flap 27 in the closed position, the book may be closed so that flap 27 resides between the pages 35 and the cover 16 of book 12.

Thus, calculator 11 is conveniently attached to book 12 for use both during periods of instruction and during periods on non-use. Because of the thinness of calculator 11 and flap 27 relative to the average thickness of the standard textbook, closing of book 12 places only minimal stress upon the binding. However, if desired, physical alteration or modification of either the pages of the cover of the book may be performed to further minimize any stress upon the binding of the book.

Figure 2:
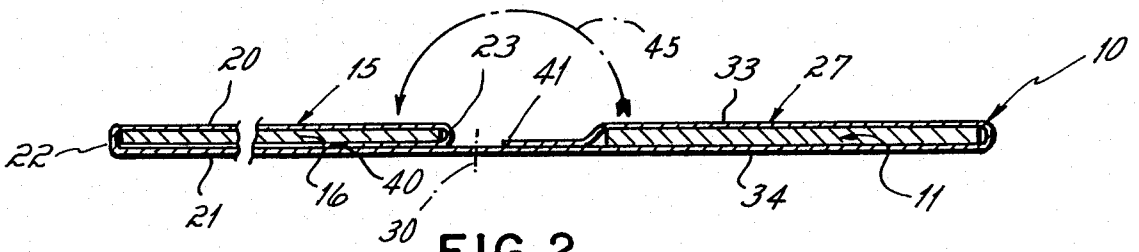
FIG. 2 is a cross section taken along lines 2—2 of FIG. 1.

As seen in FIG. 2, the calculator holder 10 of this invention can be formed by folding and adhesively securing, where necessary, one piece of cardboard. A first end 40 of the cardboard is adhesively secured to back panel 21 to form sleeve 15. The size of the book 12 and the desired snugness of the fit will determine the location at which first edge 40 is secured. From first end 40, the cardboard extends toward bottom edge 23 where it folds to form front 20 of sleeve 15. The cardboard then extends toward the top edge 22 and folds to form back 21 of sleeve 15. The cardboard continues past bottom edge 23 and fold line 30 to form bottom panel 34 of flap 27. The cardboard then folds to form front panel 33 and extend toward fold line 30 where it finally terminates at second end 41, which is adhesively secured to define flap 27. In this embodiment of the invention, the thickness of flap 27 with calculator 11 in place is generally about the same as the combined thickness of front panel 20, back panel 21 and back cover 16.

While the above description constitutes a preferred embodiment of the calculator holder of this invention, it is to be understood that the invention is not limited thereby and that in light of the present disclosure of the invention, various other alternative embodiments will be apparent to a person skilled in the art. Accordingly, it is to be understood that changes may be made without departing from the scope of the invention as particularly pointed out and distinctly claimed in the claims set forth below.

We claim:

1. In combination a book and a calculator holder said book having a top surface and a bottom surface and two outer covers separated by a plurality of pages;

said pages extending in a vertical direction from said top surface to said bottom surface of said book said holder having a sleeve having a top edge and a bottom edge, a front side and a back side and a first and a second open side edges and one of said covers extending through said first open side edge between said front side and back side holding said holder to said book;

said holder further having a flap having a top and bottom surfaces said flap hingedly connected to said bottom edge of said sleeve a calculator secured to said flap said calculator exposed for use when said flap is in an open position said entire calculator positioned between said pages and said one of said covers when in a closed position.

* * * * *